United States Patent [19]

Goerlich

[11] Patent Number: 5,038,562

[45] Date of Patent: Aug. 13, 1991

[54] BURNER FOR REGENERATION OF A PARTICLE FILTER DEVICE

[75] Inventor: Dieter Goerlich, Roggensteinerst, Fed. Rep. of Germany

[73] Assignee: Webasto AG Fahrgeutechnik, Fed. Rep. of Germany

[21] Appl. No.: 391,927

[22] Filed: Aug. 10, 1989

[30] Foreign Application Priority Data

Aug. 19, 1988 [DE] Fed. Rep. of Germany ..... 3828248

[51] Int. Cl.[5] ..... F01N 3/02

[52] U.S. Cl. ..... 60/274; 60/303

[58] Field of Search ..... 60/303, 274

[56] References Cited

U.S. PATENT DOCUMENTS 4,345,431 8/1982 Suzuki ..... 60/303

4,651,524 3/1987 Brighton ..... 60/303

FOREIGN PATENT DOCUMENTS 135612 7/1985 Japan ..... 60/303

*Primary Examiner*—Douglas Hart

*Attorney, Agent, or Firm*—Sixbey, Friedman, Leedom & Ferguson

[57] ABSTRACT

A process is for the operation of a burner, particularly an exhaust gas burner, which is intended for the regeneration of particle filter device in the exhaust gas section of a diesel internal combustion engine, for example. The burner has a precombusiton chamber, in which precombustion of a mixture of auxiliary air, exhaust gas and fuel is carried. In an afterburning chamber, heat generated from the precombustion chamber is used for the preparation of the fuel fed into the afterburing chamber to accelerate the combustion reaction. A burner intended for this process has a fuel feed device which introduces fuel into the precombustion chamber in a manner such that at least a portion of the fuel passes, in a manner that is substantially unaffected by the combustion in the precombustion chamber, into the afterburning chamber. With the operating process according to the invention and with the burner according to the invention, despite the use of the residual oxygen of exhaust gases in the burner, a rapidly proceeding combustion can be achieved with the least possible construction volume.

18 Claims, 2 Drawing Sheets

BURNER FOR REGENERATION OF A PARTICLE FILTER DEVICE

BACKGROUND OF THE INVENTION

The invention relates to a process for the operation of a burner, particularly a burner utilizing the residual oxygen of exhaust gas of an internal combustion engine to combust fuel for the regeneration of a particle filter device in an exhaust gas section of the internal combustion engine, as well as to a burner for this purpose.

It has been shown that, in a burner operated utilizing the residual oxygen of exhaust gas of an internal combustion engine to combust fuel, i.e., a so-called exhaust gas burner, which is intended for the production of hot combustion gases, which are used for the regeneration of a particle filter device in the exhaust gas section of an internal combustion engine, for example, a diesel internal combustion engine, the combustion reactions proceed slowly. As a result, the overall behavior of the combustion is sluggish. Thus, a larger burner is necessary for this purpose, which makes possible a correspondingly long retention time of the reactants.

SUMMARY OF THE INVENTION

The object of the invention is to make available a process for the operation of a burner, particularly a so-called exhaust gas burner as well as a burner for this purpose, which make possible a more effective operation and combustion that proceeds in an improved manner in the smallest possible construction volume.

According to the invention, for this purpose, a process for the operation of a burner, particularly a burner utilizing the residual oxygen of exhaust gas from an internal combustion engine to combust fuel for the regeneration of a particle filter in the exhaust gas section of an internal combustion engine carries out precombustion in a precombustion chamber with auxiliary air which is fed in, and in an afterburning chamber, by the heat generated in the precombustion chamber, the fuel fed to the afterburning chamber is prepared and the combustion reaction is accelerated.

In the process according to the invention, precombustion is carried out and the heat thus generated is used in the afterburning to achieve a good mixture in the afterburner in that the fuel evaporates and is partially cracked to make the mixture as a whole reactive. By this technique, the hot combustion gases emerging from the afterburning chamber for the start of the regeneration of the particle filter device are produced by a combustion that proceeds generally more quickly. As a result, it is possible to get by with a burner of smaller dimensions. Preferably, in the operating process according to the invention, a portion of the fuel fed into the precombustion chamber is conducted through the precombustion chamber largely unaffected and is fed into the afterburning chamber. Thus, an amount of fuel necessary for reliable combustion is always available in the afterburning chamber, without the combustion in the precombustion chamber being influenced or disturbed by it in any significant way. Further, in this way, the fuel fed into the afterburning chamber can be prepared by the heat generated in the precombustion chamber under favorable conditions, so that a fast proceeding combustion can be achieved in the afterburning chamber.

Suitably, the combustion is carried out, as a whole, in the precombustion chamber with an excess air number of $\lambda < 1$, so that a relatively small amount of auxiliary air is sufficient for the combustion in the precombustion chamber. Of course, this specification refers to a value averaged over the cross section of the precombustion chamber. The combustion in the precombustion chamber can be visualized in the form of a flame that envelops a rich nucleus, i.e., one rich in fuel. In this rich nucleus in the precombustion chamber, the excess air number $\lambda$ approaches zero, while it approaches 1 in the outer areas. To summarize, the air excess number $\lambda$ is then clearly smaller than 1.

According to a further aspect according to the invention, a burner, particularly a burner operated with the residual oxygen of exhaust gas from an internal combustion engine used to combust fuel for the regeneration of a particle filter device in the exhaust gas section of an internal combustion engine, having a precombustion chamber and an afterburning chamber, in which combustion of exhaust gas and fuel takes place, and having a fuel feed device, is distinguished in that the fuel feed device introduces fuel into the precombustion chamber and a portion of the fuel passes into the afterburning chamber, largely unaffected by the combustion in the precombustion chamber.

In such a burner, suitably a single fuel feed device is, thus, used for the overall supply of the burner, i.e., for the combustion in the precombustion chamber and in the afterburning chamber. Thus, the construction expenditure in a burner operated according to the process of the invention can be simplified. Further, in this way, the amounts of fuel to be fed into the precombustion chamber and into the afterburning chamber can be regulated in a simplified way, without additional fuel feed devices being needed which have to be controlled in chronological sequence in mutual dependence. Additionally, from the time that the burner is put into service, fuel is fed both to the precombustion chamber and to the afterburning chamber almost simultaneously, so that the heat generated in the precombustion chamber can be immediately used for the preparation of the mixture in the afterburning chamber and, particularly, for the fuel preparation and for combustion in the afterburning chamber there is essentially no dependence on the residual amount of fuel in the combustion gas emerging from the precombustion chamber. In this way, in the burner according to the invention, hot combustion gases are obtained effectively and quickly at the outlet of the afterburning chamber, so that an effectively working exhaust gas burner is obtained for the regeneration of a particle filter device.

Advantageously, an auxiliary air feed device is provided for the precombustion chamber which feeds a suitable, preferably small, amount of auxiliary air for the stabilization of the combustion utilizing the exhaust gas in the precombustion chamber. In this way, the ignition performance of the mixture in the area of the precombustion chamber can be improved and a reliable ignition of the flame in the precombustion chamber can be guaranteed, even with exhaust gases with a low residual oxygen content.

Preferably, the precombustion chamber and the afterburning chamber merge into one another so that the heat generated during the combustion in the precombustion chamber reaches the afterburning chamber for the fuel preparation and to increase the reactivity. Suitably, the afterburning chamber, thus, adjoins the precombustion chamber axially downstream from a part of reduced cross section, so that the precombustion chamber and the afterburning chamber are axially connected to one another so as to obtain a transference of heat to the afterburning chamber with the least possible loss of the heat generated by the combustion in the precombustion chamber, and in particular, the most compact type of construction possible for this kind of burner having precombustion and afterburning chambers.

The axial structural length of such a burner can be even further reduced by separating the precombustion chamber and the afterburning chamber by a baffle plate with an axially running hole disposed at their transition point. The baffle plate with the hole then forms the part of reduced cross section. A separate transition segment connected between the precombustion chamber and the afterburning chamber can, then, be omitted.

Preferably, in the burner according to the invention, the fuel feed device is formed by a multihole nozzle that juts into the precombustion chamber, and has at least one nozzle hole through which the fuel jet sent out is injected, essentially, directly into the afterburning chamber. This nozzle hole for the fuel jet that is to be directed into the afterburning chamber is, preferably, located approximately in the area of the nozzle tip, or seen in cross section about in the middle of the fuel feed device. Advantageously, the multihole nozzle has at least two additional nozzle holes, by which the fuel is injected into the precombustion chamber. In this way a simplified embodiment of a fuel feed device is obtained, since only one single nozzle is needed, which has several nozzle holes, which can be selected and placed so that both the precombustion chamber and the afterburning chamber can be supplied with fuel in a reliable way. Of course, combinations of more than three nozzle holes in the multihole nozzle are possible, and this number of nozzle holes is largely dependent on the geometry and the layout of the precombustion chamber and the afterburning chamber.

The combustion in the precombustion chamber suitably should take place with an excess air number of $\lambda < 1$, as a whole, i.e., as averaged by way of its cross section.

Suitably, the burner is configured so that, in the precombustion chamber, a significantly smaller output is produced than in the afterburning chamber with the least possible auxiliary air.

To reduce the dimensions in the axial direction and crosswise, a baffle barrier with a central opening is placed as a fuel feed device at a distance from the nozzle, and through this opening fuel goes directly to the afterburning chamber. The baffle barrier can be designed as a disk, cone, ball socket or the like.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
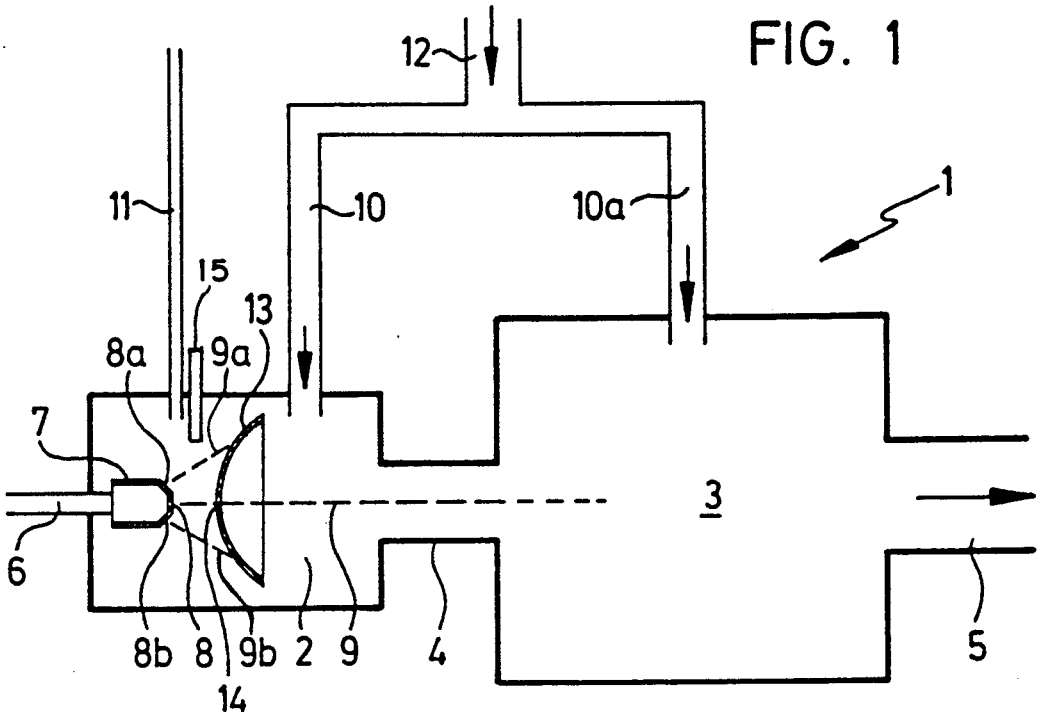
FIG. 1 is a diagrammatic view of a burner according to the invention.

The burner represented in FIG. 1 is designated, as a whole, with reference numeral 1, and it is particularly a so-called exhaust gas burner, i.e., a burner which is operated utilizing residual oxygen of exhaust gases in an exhaust gas line of an internal combustion engine for combustion of fuel to produce hot combustion gases for the regeneration of a particle filter (not shown) which is connected downstream of the burner for purifying exhaust gases from a diesel internal combustion engine. Burner 1 has a precombustion chamber 2 and an afterburning chamber 3. In the example represented, afterburning chamber 3 axially adjoins precombustion chamber 2 with the intake of the afterburning chamber 3 being connected with the outlet of precombustion chamber 2 by a connection segment 4 which is of reduced cross-sectional area relative to these chambers. The outlet of the afterburning chamber 3 is designated with 5, which is the sole outlet for gases from burner 1.

A fuel feed device 6 is shown that has a multihole nozzle 7 which axially juts into precombustion chamber 2. In particular, nozzle 7 has, in all, at least three nozzle holes 8, 8*a*, 8*b*, which are placed in the area of the nozzle tip of multihole nozzle 7. Nozzle hole 8 is located approximately in the middle of the nozzle tip of multihole nozzle 7 and a fuel jet 9 is sent out through hole 8 as represented by a broken line in FIG. 1. Fuel jet 9 passes through precombustion chamber 2 (in a manner that is substantially unaffected by the combustion in the precombustion chamber) and, by way of connection segment 4 or the axial opening of a baffle plate, enters afterburning chamber 3. Fuel jets 9*a* and 9*b* produced by the two other nozzle holes 8*a*, 8*b* are directed into precombustion chamber 2 at an angle of inclination relative to the center axis of multihole nozzle 7, so that the fuel of these fuel jets 9*a*, 9*b* remains in the area of precombustion chamber 2 and is used there for combustion.

Exhaust gas feed device 10 and auxiliary air feed device 11 are connected to precombustion chamber 2, so that a mixture of exhaust gas, auxiliary air and fuel is produced and is brought to combustion in precombustion chamber 2, a glow plug 15 or other ignition means being provided therein for initiating combustion. BY exhaust gas feed device 10, a portion of the stream of the exhaust gas in exhaust gas line 12 is suitably fed into precombustion chamber 2 in a manner that can be controlled. The heat resulting from this combustion is further passed on to afterburning chamber 3, into which exhaust gas feed device 10*a* empties the remaining flow from line 12. This exhaust gas is mixed with the fuel of fuel feed device 6 coming out by nozzle hole 8 to form a mixture, and the preparation of the mixture is supported by the heat generated during the combustion in precombustion chamber 2.

Figure 2:
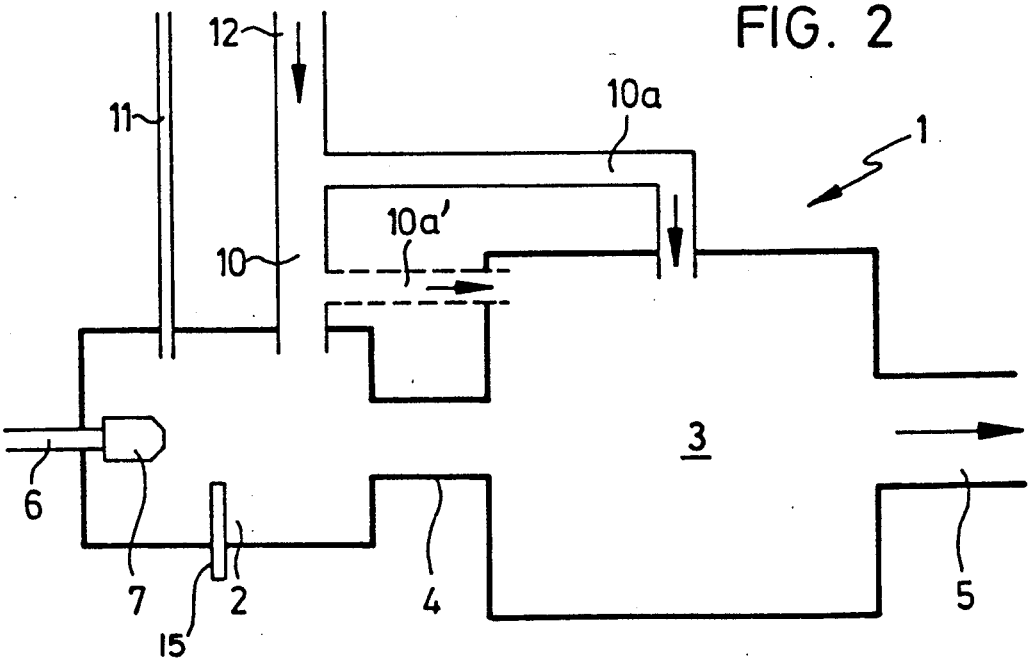
FIG. 2 is a diagrammatic view of a modified burner with more details of the exhaust gas supply of the afterburning chamber.

The same or similar parts as in burner 1 according to FIG. 1 are provided with the same reference numbers in the example of burner 1' represented in FIG. 2. An explanation of these identical parts can thus be omitted.

In FIG. 2 several examples of the direction for introducing the exhaust gas into afterburning chamber 3 are shown. With the aid of exhaust gas feed device 10*a'*, the exhaust gases are introduced axially into afterburning chamber 3, while a radial introduction of the exhaust gas line takes place from exhaust gas feed device 10*a*. The exhaust gases can also be introduced in a combined way, i.e., axially and radially, for example. By a corresponding displacement of the intake of exhaust gas feed device 10*a* it is possible to have the exhaust gas tangentially conveyed into afterburning chamber 3, preferably with a spinning path relative to the axis of afterburning chamber 3 (see FIG. 3). BY these different directions for introducing the exhaust ga into afterburning chamber 3, the preparation of the mixture in afterburning chamber 3 can be optimized, taking into account the respective conditions, particularly in view of the volume of afterburning chamber 3.

Burners 1, 1', 1'' according to the invention, are operated in the way described below.

When burner 1, 1', 1'' is started up, fuel feed device 6, 6'' auxiliary air feed device 11 and exhaust gas feed device 10 are controlled so that in the precombustion chamber a mixture of exhaust gas, auxiliary air and fuel is obtained, which, as an overall average, preferably has an air excess number of $\lambda < 1$, i.e., the operation in the precombustion chamber 2, 2'' takes place preferably under the condition $\lambda < 1$. When fuel feed device 6, 6'' is being operated, fuel is also injected via the fuel jet 9, 9'', from hole 8 almost directly into afterburning chamber 3, 3'', so that the exhaust gas fed by exhaust gas feed device 10*a*, 10*a*; 10*a''* is mixed with the fuel in afterburning chamber 3 to prepare a combustible mixture. The preparation of the fuel and the course of the combustion reaction are supported by the heat which reaches the afterburning chamber from precombustion chamber 2, 2'', so that the combustion in afterburning chamber 3, 3'' takes place at a high temperature and at a high combustion speed. Thanks to good mixing and the reactivity of the mixture in afterburning chamber 3, burner 1, 1', 1'', seen as a whole, quickly provides hot combustion gases to outlet 5, 5'' which can be used for initiating the regeneration of a particle filter device connected downstream thereof. Further, burner 1, 1', 1'', as a whole, is operated so that the major part of the output reaction takes place in afterburning chamber 3, 3'', so that the hot combustion gases coming out through outlet 5, 5'' have a temperature sufficient for regeneration. The least possible amount of auxiliary air is fed into precombustion chamber 2, 2'' and the output thus produced is significantly less than the output produced in afterburning chamber 3, 3''.

Of course, burners 1, 1', 1'' according to the invention, can be modified in many respects and further developed. In particular, more than three fuel jets can be delivered from the multihole fuel nozzle, or the fuel feed device, for example, can be designed as a double or multiple nozzle. Also, the configurational details of burners 1, 1', 1'' are not limited to the embodiments represented, but further embodiments are also possible.

As it is shown in broken lines in FIG. 1, in precombustion chamber 2, a baffle barrier 13 can be placed axially at a distance from fuel feed device 6, and this baffle barrier 13 has an opening 14 located somewhat centrally, through which fuel passes to afterburning chamber 3. Baffle barrier 13 can be designed as a cone, a sphere, a ball socket, a disk or combinations of these.

Figure 3:
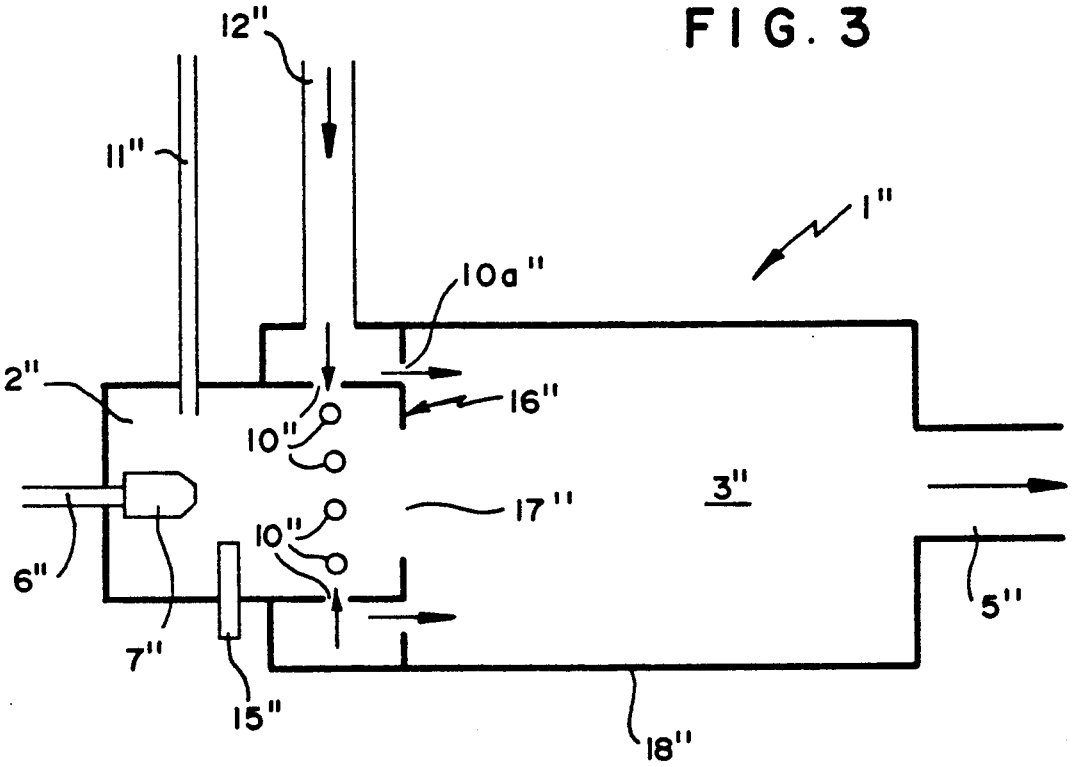
FIG. 3 is a diagrammatic view similar to FIG. 2 in which a baffle barrier is used and having a modified means for feeding exhaust gas to a precombustion chamber and to a afterburning chamber.

FIG. 3 shows a modification of the embodiment of FIG. 2, wherein the same or equivalent parts bearing the same reference numbers but with the suffix ''.

According to the embodiment of the burner 1'' instead of the connection segment 4 of the former embodiments there is shown a baffle barrier formed by a baffle plate 16'' having an axially extending opening 17''. This baffle plate 16'' separates the precombustion chamber 2'' and the afterburning chamber 3''. Further as shown in FIG. 3 the exhaust gas coming from the exhaust gas line 12'' is supplied to the precombustion chamber 2'' via tangential and radial inlet means 10''. The housing 18'' of the afterburning chamber 3'' is axially extended and surrounds partially the precombustion chamber 2''. The exhaust gas feed device 10*a''* opens axially into the afterburning chamber 3'' but is integrally formed by a part of the wall extension of the housing 18''.

While I have shown and described various embodiments in accordance with the present invention, it is understood that the same is not limited thereto but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Burner utilizing residual oxygen of exhaust gas to combust fuel for the regeneration of a particle filter device in the exhaust gas section of an internal combustion engine, comprising a precombustion chamber and an afterburning chamber located downstream of the precombustion chamber and upstream of the particle filter device, combustion of fuel taking place in each of said chambers, a baffle barrier disposed upstream of the afterburning chamber, and a fuel feed device constructed and arranged within the precombustion chamber as a means for axially passing a portion of fuel supplied thereby into the precombustion chamber through an opening in the baffle barrier and into the afterburning chamber in a manner substantially unaffected by combustion in the precombustion chamber.

2. Burner according to claim 1, wherein said precombustion chamber is provided with an auxiliary air feed device which introduces auxiliary air into the precombustion chamber as a means for stabilizing combustion of the fuel utilizing the residual oxygen of exhaust gas delivered to the precombustion chamber.

3. Burner according to claim 2, wherein the precombustion chamber and the afterburning chamber are in sufficient proximity to one another for enabling sufficient heat generated during combustion in the precombustion chamber to reach the afterburning chamber as a means for preparing the fuel and accelerating combustion in the afterburning chamber.

4. Burner according to claim 3, wherein the afterburning chamber adjoins the precombustion chamber axially downstream of a part thereof which is of reduced cross section relative to said chambers.

5. Burner according to claim 4, wherein the fuel feed device is formed by a nozzle which juts into the precombustion chamber and has at least one nozzle hole through which a fuel jet is sent out that is directed into the afterburning chamber.

6. Burner according to claim 5, wherein said baffle barrier is placed within the precombustion chamber at a distance from the fuel feed device in an axial direction of the precombustion chamber.

7. Burner according to claim 5, wherein the nozzle is designed as a multihole nozzle, and has at least two additional nozzle holes by which fuel is injected into the precombustion chamber for precombustion therein.

8. Burner according to claim 7, wherein the nozzle hole for the fuel jet directed into the afterburning chamber is located approximately in a tip area of the nozzle.

9. Burner according to claim 3, wherein the afterburning chamber is separated from the precombustion chamber by said baffle barrier.

10. Burner according to claim 1, wherein an exhaust line of the engine is provided with exhaust gas feed devices for directing respective portions of a stream of exhaust passing therethrough into the precombustion chamber and into the afterburning chamber.

11. Burner according to claim 1, wherein the precombustion chamber together with the fuel feed device, respective exhaust feed device and air feed device form a means for producing combustion in the precombustion chamber in a manner resulting in an excess air number that is less than 1 when averaged over the cross section of the precombustion chamber.

12. Burner according to claim 11, wherein the exhaust gas feed device directing a portion of the exhaust gas stream into afterburning chamber is arranged to do so in at least one of axial or radial or tangential manners.

13. Burner according to claim 1, wherein said baffle barrier is placed within the precombustion chamber at a distance from the fuel feed device in an axial direction of the precombustion chamber.

14. Burner according to claim 13, wherein the baffle barrier is in the shape of one of a baffle cone, baffle plate, sphere and ball socket.

15. Burner according to claim 1, wherein the fuel feed device is formed by a nozzle which juts into the precombustion chamber and has at least one nozzle hole through which a fuel jet is sent out that is directed into the afterburning chamber.

16. Burner according to claim 15, wherein the nozzle is designed as a multihole nozzle and has at least two additional nozzle holes by which fuel is injected into the precombustion chamber for precombustion therein.

17. Burner according to claim 16, wherein an exhaust line of the engine is provided with exhaust gas feed devices for directing respective portions of a stream of exhaust passing therethrough into the precombustion chamber and into the afterburning chamber.

18. Burner utilizing residual oxygen of exhaust gas to combust fuel for the generation of a particle filter device in the exhaust gas section of an internal combustion engine, comprising a precombustion chamber and an afterburning chamber in each of which combustion of fuel takes place, and a fuel feed device constructed and arranged within the precombustion chamber as a means for passing a portion of fuel supplied thereby into the precombustion chamber, in a manner substantially unaffected by combustion in the precombustion chamber, into the afterburning chamber, said fuel feed device being formed by a multihole nozzle that juts into the precombustion chamber, said multihole nozzle having at least one nozzle hole through which a fuel jet is sent out that is directed into the afterburning chamber and at least two additional nozzle holes by which fuel is injected into the precombustion chamber for precombustion therein.

* * * * *